US007248130B2

(12) United States Patent
Bohlman

(10) Patent No.: US 7,248,130 B2
(45) Date of Patent: Jul. 24, 2007

(54) HIGH POWER COMBINER/DIVIDER

(75) Inventor: Walter A Bohlman, Quakertown, PA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 191 days.

(21) Appl. No.: 11/029,919

(22) Filed: Jan. 5, 2005

(65) Prior Publication Data

US 2006/0145780 A1 Jul. 6, 2006

(51) Int. Cl.
*H01P 5/00* (2006.01)
*H01P 5/12* (2006.01)

(52) U.S. Cl. ..... 333/127; 333/4; 333/25

(58) Field of Classification Search ..... None
See application file for complete search history.

(56) References Cited

U.S. PATENT DOCUMENTS 3,827,001 A * 7/1974 Laughlin ..... 333/127
4,291,278 A * 9/1981 Quine ..... 330/286
4,647,868 A * 3/1987 Mueller ..... 330/286
4,916,410 A * 4/1990 Littlefield ..... 330/295
5,017,886 A * 5/1991 Geller ..... 330/277
5,796,317 A 8/1998 Bohlman et al.
6,750,652 B2 * 6/2004 Weyers et al. ..... 324/318

* cited by examiner

*Primary Examiner*—Robert Pascal
*Assistant Examiner*—Kimberly E Glenn
(74) *Attorney, Agent, or Firm*—Maine & Asmus

(57) ABSTRACT

A power combiner/divider is disclosed that employs triaxial transmission line structures operatively coupled to provide a desired number of input/output ports. A balun is operatively coupled to the triaxial transmission line structures, and is adapted to couple out unbalanced currents flowing therebetween.

19 Claims, 4 Drawing Sheets

HIGH POWER COMBINER/DIVIDER

FIELD OF THE INVENTION

The invention relates to variable impedance transmission lines, and more particularly, to a high power combiner/divider employing same.

BACKGROUND OF THE INVENTION

Power combiners/dividers can be implemented in numerous configurations, and are typically specified for parameters such as maximum power dissipation, operating frequency range, insertion loss, VSWR, degree of isolation between input and output ports, and amplitude and phase balance. For purposes of brevity, the phrase power combiner/divider will simply be referred to herein as power combiner, as it is known that a power combiner can also be used as a power divider, depending on the direction of current flow.

A commonly used power combiner is the Wilkinson power combiner. The Wilkinson power combiner combines N loads or sources, while simultaneously providing isolation between those loads or sources. In general, the Wilkinson power combiner offers matched impedance conditions at all ports, a low insertion loss, and high isolation between output/input ports. Quarter-wavelength transmission lines are uniformly arranged to obtain isolation between ports by having reflected signals combine 180 degrees out of phase. Discrete isolation resistors are arranged in a network, where each resistor has one end connected to a common point and the other end connected to a different one of the transmission lines one-quarter wavelength from a common junction of that transmission line with the other transmission lines. The Wilkinson power combiner has bandwidth limitations that can only be improved by cascading multiple sections of Wilkinson combiners.

Power combiners can also be implemented with variable impedance transmission line. Here, a plurality of quarter-wavelength transmission lines are interconnected, so as to provide the input and output ports of the combiner. Each transmission line has a center conductor of constant cross-section (e.g., copper conductor), an outer conductor surrounding and coaxial with the center conductor and spaced radially therefrom, and a variable dielectric constant material between the center conductor and the outer conductor. This variable dielectric constant material transforms the transmission line impedance continuously from one end to the other to give very broad bandwidth. The center conductors of the transmission lines are connected together so as to provide input and output ports. A like plurality of resistors, each having a preselected resistance, are connected between the center conductors. Example such configurations are described in U.S. Pat. No. 5,796,317, titled "Variable Impedance Transmission Line and High-Power Broadband Reduced Size Power Divider/Combiner Employing Same", which is herein incorporated by reference in its entirety. The resistors, however, have a capacitance to ground, which can cause the balanced currents to flow through the resistors, which in turn causes signal loss.

What is needed, therefore, is a power combiner that has very broad bandwidth and low signal loss.

SUMMARY OF THE INVENTION

One embodiment of the present invention provides a power combiner that includes a first triaxial transmission line structure operatively coupled between a first input port and an output port, a second triaxial transmission line structure operatively coupled between a second input port and the output port, and a balun that is operatively coupled to the first and second triaxial transmission line structures, and adapted to couple out unbalanced currents flowing therebetween. The power combiner may further include a housing that provides a ground plane to which outer conductors of the first and second triaxial transmission line structures are integral or otherwise connected. Note that the power combiner may also be used as a power divider.

Each of the first and second triaxial transmission line structures can be similarly configured, for example, with a dielectric material between an outer conductor and a semi-rigid coax cable having its shield used as a center conductor of the transmission line structure. Note, however, that the semi-rigid coax cable of the first triaxial transmission line structure can have a first impedance (e.g., 100 ohm), and the semi-rigid coax cable of the second triaxial transmission line structure can have a second impedance (e.g., 10 ohm). Also, a portion of center conductor of the semi-rigid coax cable of the second triaxial transmission line structure can be removed, so as to provide the balun with an open-circuited stub (in a compensated balun configuration). The dielectric material for each of the first and second triaxial transmission line structures may include a number of high dielectric constant material disks and low dielectric constant material disks arranged in an alternating fashion, so as to transform transmission line impedance continuously from one end of the corresponding structure (e.g., low impedance end proximate the input ports) to the other end (e.g., high impedance proximate the output port).

In one particular case, the balun includes a length of semi-rigid coax cable forming part of a short-circuited stub that is operatively coupled between a load proximate the input ports and the semi-rigid coax cables of the first and second triaxial transmission line structures proximate the output port, thereby enabling unbalanced currents flowing between the first and second triaxial transmission line structures to flow to the load instead of the output port. The unbalanced currents coupled out by the balun flow to the load by way of the center conductor of the semi-rigid coax cable of the first triaxial transmission line structure and the short-circuited stub, which shunts the output of the power combiner. The length of semi-rigid coax cable forming part of a short-circuited stub can be in the range of about one-quarter wavelength of a desired center frequency to about four-tenths wavelength at a highest frequency. Note that at least one of ferrite and dielectric materials (e.g., in the form of blocks, disks, slabs) can be arranged along the semi-rigid coax cable forming part of a short-circuited stub, so as to increase the impedance of the stub (which reduces its shunting effect). The balun can be connected, for example, between the center conductor of the semi-rigid coax cable of the first triaxial transmission line structure and the center conductor of the semi-rigid coax cable of the second triaxial transmission line structure, thereby providing a compensated balun. Alternatively, the balun can be connected between the center conductor of the semi-rigid coax cable of the first triaxial transmission line structure and the shield of the semi-rigid coax cable of the second triaxial transmission line structure.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

Note that the various features shown in the Figures are not drawn to any particular scale. Rather, the Figures are drawn to emphasize features and structure for purposes of explanation. The actual geometries and scale of the pertinent features and structure will be apparent in light of this disclosure.

DETAILED DESCRIPTION OF THE INVENTION

A power combiner is described herein that has very broad bandwidth and low signal loss, relative to conventional configurations. Variable impedance transmission line is used in conjunction with a means that eliminates the lossy resistors of conventional designs. In particular, a port is provided that couples out unbalanced currents. This port is essentially a balun that is integrated into the power combiner.

Unlike conventional combiners, which typically use a solid copper conductor for the center conductor of the variable impedance transmission line, an embodiment of the present invention uses the shield of semi-rigid coax cable as the center conductor of the variable impedance transmission line. A variable dielectric constant material is provided around the semi-rigid cable, so as to transform the transmission line impedance continuously from one end to the other to give very broad bandwidth. An outer conductor is provided around the variable dielectric constant material. The resulting transmission line has a triaxial structure.

Triaxial Transmission Line Structure

Figure 1A:
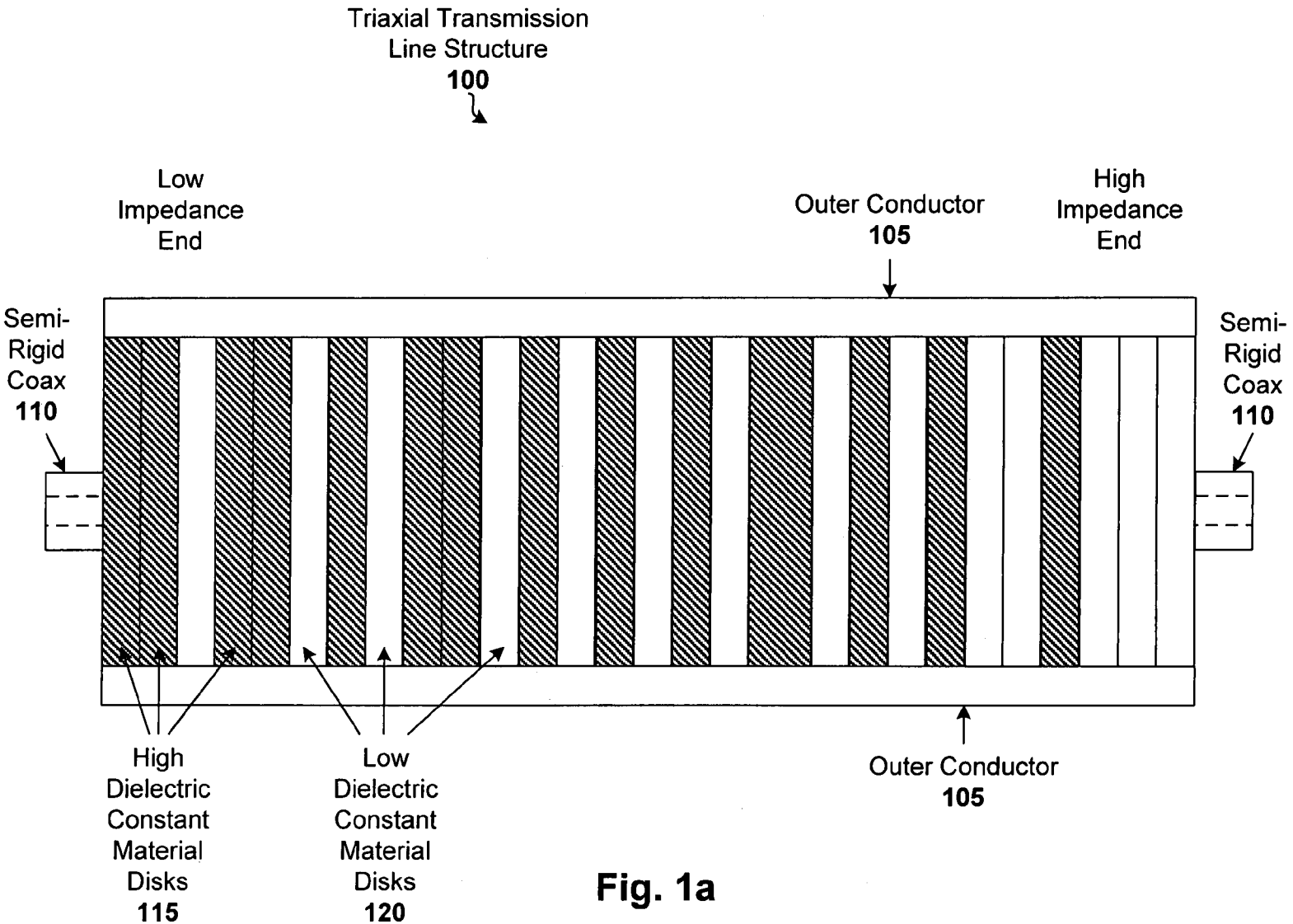
FIG. 1*a* shows a cross-section of a triaxial transmission line structure configured in accordance with one embodiment of the present invention.

FIG. 1*a* shows a cross-section of a triaxial transmission line structure configured in accordance with one embodiment of the present invention. Such a triaxial transmission line structure can be used to implement a power combiner configured in accordance with the principles of the present invention.

As can be seen, the triaxial transmission line structure 100 includes an outer conductor 105 and a semi-rigid coax cable 110. In between the outer conductor 105 and the coax 110 is a variable dielectric constant material, which includes high dielectric constant material disks 115 and low dielectric constant material disks 120. Here, the center conductor of the triaxial transmission line structure 100 is the shield of the semi-rigid coax 110. Note that this shield is sometimes referred to as the outer conductor of the semi-rigid coax 110, which is not to be confused with the outer conductor 105 of the triaxial transmission line structure 100.

The high dielectric constant material disks 115 and low dielectric constant material disks 120 are arranged in an alternating fashion, so as to transform the transmission line impedance continuously from one end (e.g., low impedance end) to the other end (e.g., high impedance end). Generally stated, as dielectric constant increases, impedance decreases. This impedance transformation enables a very broad bandwidth of operation (e.g., greater than 5:1 bandwidth), so as to accommodate numerous applications in which the transmission line structure 100 can be used. Alternative embodiments may simply have a uniform dielectric constant material between the outer conductor 105 and the coax 110, if suitable to the particular application at hand. The disks 115 and 120 have a square or rectangular shape in this embodiment, so as to simplify the manufacturing process and housing of the transmission line structure 100.

Note that not all of the high dielectric constant material disks 115 need have the same high dielectric constant. Likewise, not all of the low dielectric constant material disks 120 need have the same low dielectric constant. Rather, the dielectric constants of the individual disks can vary along the length of the semi-rigid coax 110. Further note that the occurrence of high dielectric constant material disks 115 is greater at the low impedance end of the transmission line, and the occurrence of low dielectric constant material disks 120 is greater at the high impedance end of the transmission line. Numerous configurations of alternating high and low dielectric constant material can be used here, with the goal to transform the transmission line impedance continuously from a low impedance end to a high impedance end.

For example, the low dielectric constant material disks 120 may start with a dielectric constant of 1.4 at the high impedance end of the transmission line structure 100, and gradually transition to a dielectric constant of 6.0 at the low impedance end of the transmission line. In a similar fashion, the high dielectric constant material disks 115 may start with a dielectric constant of 2.0 at the high impedance end of the transmission line, and gradually transition to a dielectric constant of 10.0 at the low impedance end of the transmission line. Example dielectric materials having a low dielectric constant include foam, polymer films, and PTFE. Example dielectric materials having a high dielectric constant include thermoset resin/ceramic (e.g., Roger's TMM) and PTFE/ceramic. There are numerous commercially available materials having dielectric constants ranging from about 1 to over 10 that can be used to implement the high dielectric constant material disks 115 and the low dielectric constant material disks 120.

Figure 1B:
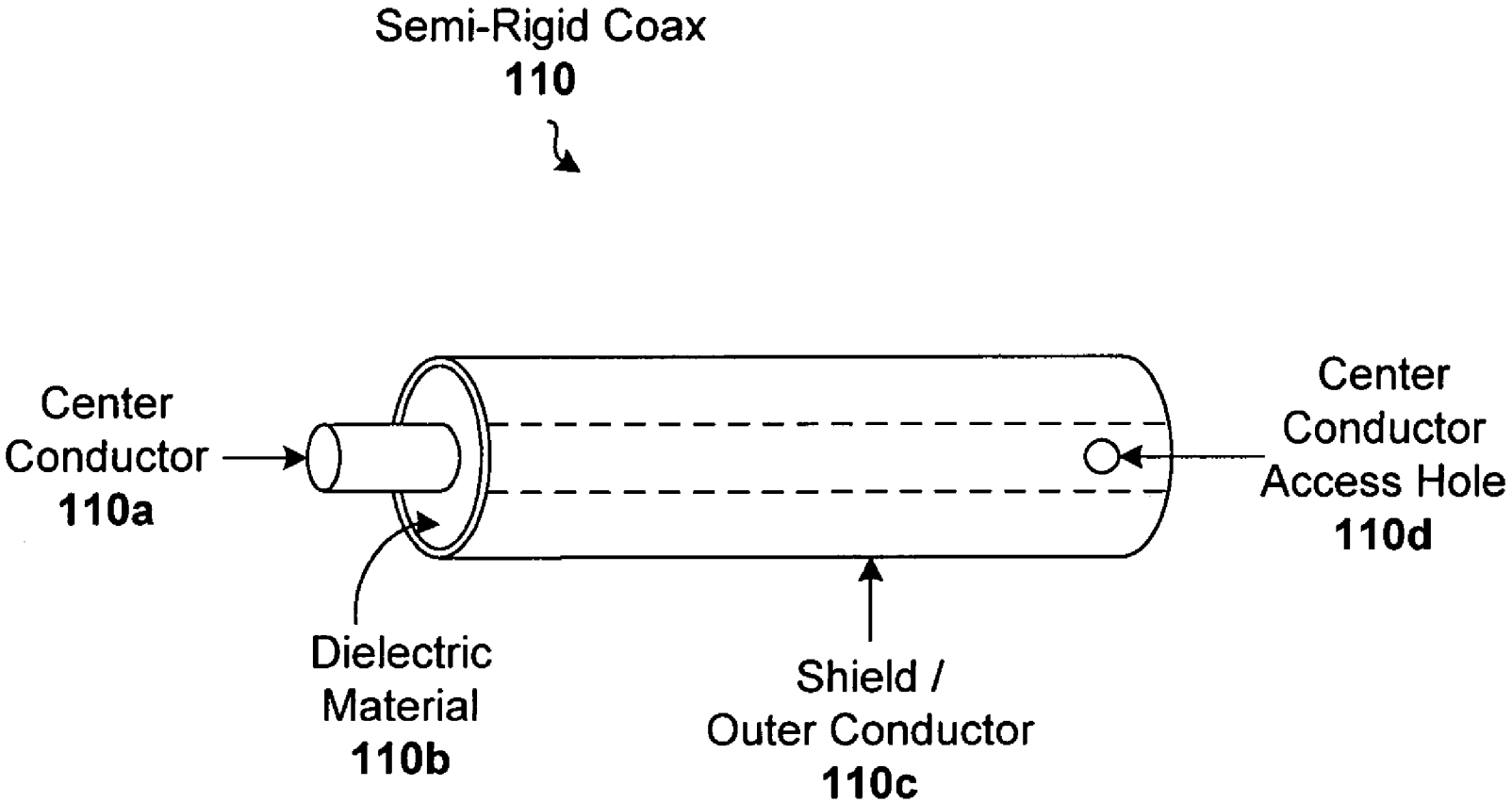
FIG. 1*b* shows a semi-rigid coaxial cable that can be used in the triaxial transmission line structure of FIG. 1*a*.

FIG. 1*b* shows an example semi-rigid coaxial cable 110 that can be used in the triaxial transmission line structure of FIG. 1*a*. As can be seen, the semi-rigid coaxial cable 110 includes a center conductor 110*a*, a dielectric material 110*b*, and a shield 110*c*, and can be implemented with conventional off-the-shelf semi-rigid coax or custom semi-rigid coax cable. The material making up the coax 110, as well as it operating parameters (e.g., frequency range and impedance) can be selected based on the particular application at hand, as will be apparent in light of this disclosure.

As previously explained, the shield 110*c* acts as the center conductor for the overall triaxial transmission line structure 100 of FIG. 1*a*. The center conductor 110*a* of coax 110 forms part of a balun that couples out unbalanced currents as will be explained in reference to FIGS. 2*a* and 2*b*. This center conductor 110*a* can be accessed by way of the center conductor access hole 110*d*. Other means can be used here to provide access to the center conductor 110*a*, such as slits or other openings through the dielectric material 110*b* and shield 110*c*.

Power Combiner Structure

Figure 2A:
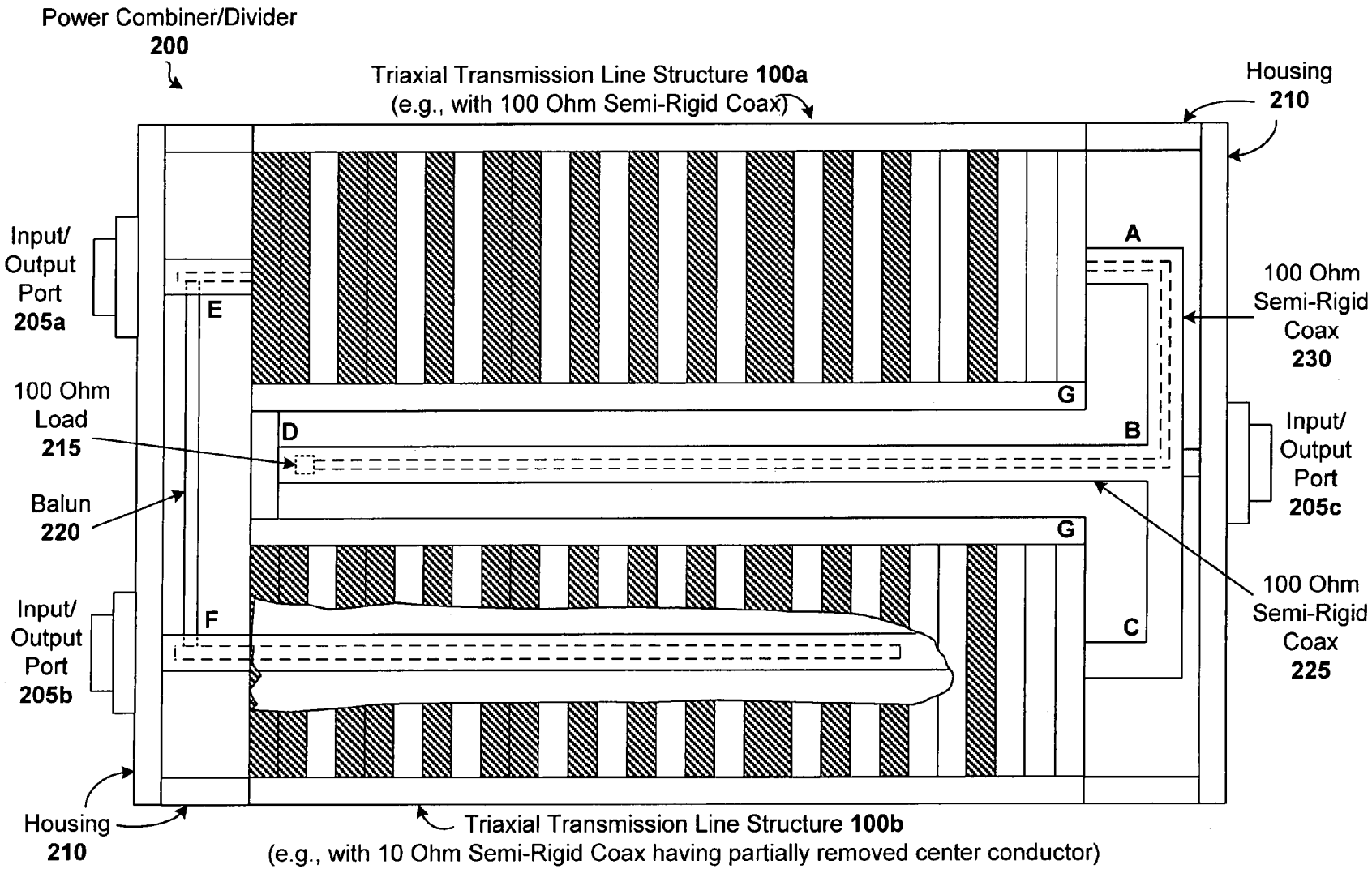
FIG. 2*a* shows a power combiner structure configured with a short-circuited stub (with no loading) in accordance with one embodiment of the present invention.

FIG. 2*a* shows a power combiner structure configured in accordance with one embodiment of the present invention.

With this example configuration, two input signals can be combined into one output signal. Other embodiments can be configured to combine a greater number (N) of input signals into a single output signal, as will be apparent in light of this disclosure. Note that when operating as a power divider, a single signal can be divided into N output signals using the same principles as discussed in the context of combining signals.

The power combiner 200 includes two triaxial transmission line structures 100*a* and 100*b* (shown in cross section), as discussed in reference to FIGS. 1*a* and 1*b*. In this particular example, transmission line structure 100*a* is fabricated with a 100 ohm semi-rigid coax 110, and transmission line structure 100*b* is fabricated with a 10 ohm semi-rigid coax 110 that has a portion of its center conductor 110*a* removed so as to provide a compensated balun configuration. Other impedance and balun schemes will be apparent in light of this disclosure.

The center conductors of each structure 100*a* and 100*b* (recall that the shield 110*c* of the respective semi-rigid coax cable 110 provides the center conductor for each structure 100) are coupled to input ports 205*a* and 205*b*, respectively. Note that the input ports 205*a* and 205*b* are coupled to the low impedance end of the structures 100*a* and 100*b*. At their other ends, the center conductors of each structure 100*a* and 100*b* are coupled together by a 100 ohm semi-rigid coax 230, which is coupled to the output port 205*c*. Note that a portion of the center conductor 110*a* of the 100 ohm semi-rigid coax 230 has been removed (between points B and C). The output port 205*c* is coupled to the high impedance end of the transmission line structures 100*a* and 100*b*.

Semi-rigid coax cable 225 (which is also 100 ohm semi-rigid coax in this example) is tied into the semi-rigid cable 230 near the output port 205*c* at one end, and is coupled to a 100 ohm load 215 at its other end. A balun 220 is operatively coupled to the semi-rigid coax cables 110 of each structure 100*a* and 100*b*. Note that the center conductor 110*a* of the semi-rigid coax cables 110, 225, and 230 is shown as a dashed line, and is essentially part of the balun 220.

A housing 210 provides overall mechanical support for the combiner 200, as well as a robust ground plane, and can be made from, for example, steel, aluminum or copper. In the embodiment shown, the housing 210 is formed in conjunction with portions of the outer conductor 105 of each structure 100*a* and 100*b* as shown. Top and bottom plates (not shown) of the housing 210 would fully enclose the structures 100*a* and 100*b*, and provide the remainder of the outer conductor 105 (e.g., on the top and bottoms of the square/rectangular disks 115 and 120). Further note that the ports 205*a*, 205*b*, and 205*c* are mounted on the housing 210 as conventionally done. Numerous housing configurations and grounding schemes are possible here.

In this particular embodiment, each of the semi-rigid coax cables 110, 225, and 230 are implemented with conventional 100 ohm semi-rigid cable, with the exception of the semi-rigid coax cable 110 for triaxial transmission line structure 100*b*, which is conventional 10 ohm semi-rigid cable. Here, output port 205*c* is a 50 ohm output (assuming the device is used as a combiner), and input ports 205*a* and 205*b* are 50 ohm inputs. It will be appreciated that other impedance schemes can be used here as well, and the type of semi-rigid cable used will vary with each application.

As previously explained, the center conductor 110*a* of the semi-rigid coax cables 110, 225, and 230 forms part of the balun 220. The terminals of the balun 220 are at points E and F. Note that balun 220 can be coupled to the center conductors 110*a* via a center conductor access hole 110*d*, or other opening (e.g., slit) in the shield 110*c*. The other end of the balun 220 is at point D, where the center conductor 110*a* of the semi-rigid coax 225 breaks out the external 100 ohm load 215. In this sense, the center conductor 110*a* of the semi-rigid coax 225 connects the balun output to the load 215. This load 215 has one side grounded so that any form of external load can be attached and thus provide a high power termination. The shield 110*c* of the semi-rigid coax 225 is grounded at point D (by being coupled to the housing 210). This ground point is the base of a short-circuited stub, and the high impedance end of the stub is at point B. The shield 110*c* of the semi-rigid coax 225 is the center conductor of this stub, and the outer conductors 105 (also designated G in FIG. 2*a*) of the neighboring structures 100*a* and 100*b* provide the shield of the stub. Thus, the output of the power combiner 200 (at port 205*c*) is shunted by a short-circuited stub at point B.

The length of the semi-rigid coax cable 225 can be selected based on the desired operating frequency. In one embodiment, the semi-rigid coax cable 225 has a length (from about point D to B) in the range of about one-quarter the wavelength of the desired center frequency, to an extreme length of about four-tenths the wavelength at a highest frequency. With a length of about one-quarter the wavelength between points D and B, the impedance between points B and G is the highest, thereby making the stub look like an open-circuit at frequencies of interest. Thus, those frequencies will go to the output port 205*c*. However, the impedance between points B and G decreases at frequencies of non-interest (e.g., greater than about fourth tenths of a wavelength), thereby causing some signal energy at those frequencies of non-interest to flow to ground at point D. Note that the distance of semi-rigid coax cable 225 that extends beyond the outer conductors 105 of structures 100*a* and 100*b* can be minimized (e.g., less than 5 millimeters), so as to minimize the portion of the stub that has no shield.

It is desirable to have the impedance of this stub as high as possible, so as to minimize the shunting effect. Thus, techniques can be employed to increase this impedance. The shunting impedance is -controlled mainly by the cross-sectional dimensions and the length of the stub. Loading materials can be used to adjust the stub performance. These loading materials can be pure dielectric, pure ferrite or a mixture of both-dielectric and ferrite materials. For dielectric materials in one particular embodiment, the dielectric constant is a maximum in the order of 2. While dielectric loading will increase the stub length it will also lower the stub impedance from a cross-sectional point of view. Additionally ferrite material can be used alone or mixed with dielectric to tailor performance. Typical ferrite permeability of about 2 could be used, for example. The dielectric and/or ferrite loading materials can take a number of forms, such as disks, blocks or slabs disposed around or proximate the semi-rigid coax 225 that makes up the short-circuited stub.

Figure 2B:
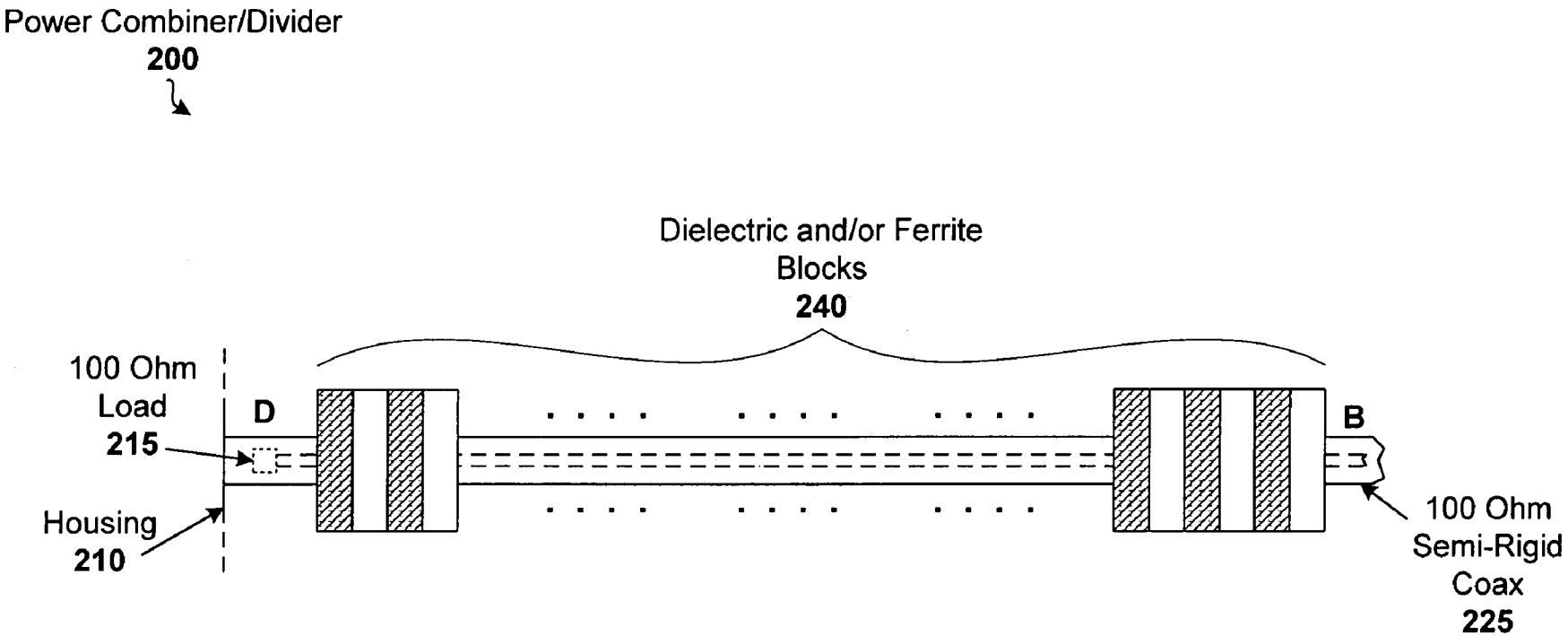
FIG. 2*b* shows a short-circuited stub of power combiner structure shown in FIG. 2*a*, but with distributed dielectric/ferrite loading.

One such loading technique is illustrated in FIG. 2*b*, which shows a partial view of power combiner structure configured in accordance with another embodiment of the present invention. Here, the length of semi-rigid cable 225 is surrounded by dielectric and/or ferrite blocks 240 (which could also be in other forms, such as disks or slabs). For example, blocks of material having alternating dielectric constants (e.g., a maximum dielectric constant of 2) could be used, or ferrite blocks having a maximum permeability of 2 could be used. These techniques can be used to raise and or tailor the impedance of the short circuited stub between points B and G.

In any case, when the signals at input ports 205*a* and 205*b* have in phase equal amplitude signals, they will combine at point B and produce an output at output port 205*c*. If the signals at input ports 205*a* and 205*b* are unbalanced in phase and amplitude, the unbalanced energy will flow between points E and F via the balun 220, and into the center conductor 110*a* of the semi-rigid coax cables 110, 230, and 225, and then into the 100 ohm load 215. If the signals at input ports 205*a* and 205*b* are 180 degrees out of phase, then all of the energy will flow into the 100 ohm load 215 via the center conductor 110*a* of the semi-rigid coax cables 110, 230, and 225.

The balun 220 can have different configurations. For example, in a first configuration, the balun 220 is coupled between the center conductor 110*a* of transmission line structure 100*a* and the center conductor 110*a* of the of transmission line structure 100*b* (e.g., via respective access holes 110*d*), thereby providing a feed for a low impedance open-circuited stub (as shown in the cut-out of structure 110*b* in FIG. 2*a*). This configuration effectively provides a compensated balun. The length of the center conductor 110*a* that is not removed from the semi-rigid coax cable 110 in the structure 100*b* is in the range of about one-quarter the wavelength of the desired center frequency, to an extreme length of about four-tenths the wavelength at the highest frequency. A second configuration is where the balun 220 is coupled between the center conductor 110*a* of transmission line structure 100*a* and the shield 110*c* of the of transmission line structure The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A power combiner comprising:

a first triaxial transmission line structure operatively coupled between a first input port and an output port, the first triaxial transmission line structure including a dielectric material between an outer conductor and a semi-rigid coax cable having a corresponding semi-rigid coax cable shield used as a center conductor of the transmission line structure;

a second triaxial transmission line structure having a similar structure to the first triaxial transmission line structure, and operatively coupled between a second input port and the output port; and a balun operatively coupled between the semi-rigid coax cables of the first and second triaxial transmission line structures, and adapted to couple out unbalanced currents flowing therebetween.

2. The power combiner of claim 1 wherein the dielectric material for each of the first and second triaxial transmission line structures includes a number of high dielectric constant material disks and low dielectric constant material disks arranged in an alternating fashion, so as to transform transmission line impedance continuously from one end of the corresponding structure to the other end.

3. The power combiner of claim 1 wherein the dielectric material for each of the first and second triaxial transmission line structures is configured to transform transmission line impedance continuously from a low impedance proximate the input ports to a high impedance proximate the output port.

4. The power combiner of claim 1 wherein the balun includes a length of semi-rigid coax cable forming part of a short-circuited stub that is operatively coupled between a load proximate the input ports and the semi-rigid coax cables of the first and second triaxial transmission line structures proximate the output port, thereby enabling unbalanced currents flowing between the first and second triaxial transmission line structures to flow to the load instead of the output port.

5. The power combiner of claim 4 wherein the length of semi-rigid coax cable forming part of a short-circuited stub is in the range of about one-quarter wavelength of a center frequency to about four-tenths wavelength at a highest frequency.

6. The power combiner of claim 4 wherein at least one of ferrite and dielectric materials are arranged along the semi-rigid coax cable forming part of a short-circuited stub, so as to increase the impedance of the stub.

7. The power combiner of claim 1 wherein unbalanced currents coupled out by the balun flow to a load instead of the output port, by way of a center conductor of the semi-rigid coax cable of the first triaxial transmission line structure and a short-circuited stub that shunts the output port.

8. The power combiner of claim 1 wherein the balun is connected between a center conductor of the semi-rigid coax cable of the first triaxial transmission line structure and a center conductor of the semi-rigid coax cable of the second triaxial transmission line structure, thereby providing a compensated balun.

9. The power combiner of claim 1 wherein the balun is connected between a center conductor of the semi-rigid coax cable of the first triaxial transmission line structure and a shield of a semi-rigid coax cable of the second triaxial transmission line structure.

10. The system of claim 1 wherein the semi-rigid coax cable of the first triaxial transmission line structure has a first impedance, and a semi-rigid coax cable of the second triaxial transmission line structure has a second impedance, and a portion of center conductor of the semi-rigid coax cable of the second triaxial transmission line structure is removed, so as to provide the balun with an open-circuited stub.

11. A power combiner comprising:

a first triaxial transmission line structure operatively coupled between a first input port and an output port, the first triaxial transmission line structure including a dielectric material between an outer conductor and a semi-rigid coax cable having a corresponding semi-rigid coax cable shield used as a center conductor of the transmission line structure, wherein the dielectric material includes a number of high dielectric constant material disks and low dielectric constant material disks arranged in an alternating fashion, so as to transform transmission line impedance continuously from one end of the transmission line structure to the other end;

a second triaxial transmission line structure having a similar structure to the first triaxial transmission line structure, and operatively coupled between a second input port and the output port;

a balun operatively coupled between the semi-rigid coax cables of the first and second triaxial transmission line structures, the balun including a length of semi-rigid coax cable forming part of a short-circuited stub that is operatively coupled between a load proximate the input ports and the semi-rigid coax cables of the first and second triaxial transmission line structures proximate the output port, thereby enabling unbalanced currents flowing between the first and second triaxial transmission line structures to flow to the load instead of the output port, by way of a center conductor of the semi-rigid coax cable of the first triaxial transmission line structure and the short-circuited stub; and a housing that provides a ground plane to which the outer conductor of the first triaxial transmission line structure and an outer conductor of the second triaxial transmission line structure are integral or otherwise connected.

12. The power combiner of claim 11 wherein the length of semi-rigid coax cable forming part short-circuited stub is in the range of about one-quarter wavelength of a center frequency to about four-tenths wavelength at a highest frequency.

13. The power combiner of claim 11 wherein at least one of ferrite and dielectric materials are arranged along the semi-rigid coax cable configured as a short-circuited stub, so as to increase the impedance of the stub.

14. The power combiner of claim 11 wherein the balun is connected between a center conductor of the semi-rigid coax cable of the first triaxial transmission line structure and a center conductor of the semi-rigid coax cable of the second triaxial transmission line structure, thereby providing a compensated balun.

15. The power combiner of claim 11 wherein the semi-rigid coax cable of the first triaxial transmission line structure has a first impedance, and the semi-rigid coax cable of the second triaxial transmission line structure has a second impedance, and a portion of center conductor of the semi-rigid coax cable of the second triaxial transmission line structure is removed, so as to provide the balun with an open-circuited stub.

16. A power combiner comprising:

a first triaxial transmission line structure operatively coupled between a first input port and an output port;

a second triaxial transmission line structure operatively coupled between a second input port and the output port; and a balun operatively coupled to the first and second triaxial transmission line structures, and adapted to couple out unbalanced currents flowing therebetween, wherein the bauln includes a length of semi-rigid coax cable forming part of a short-circuited stub that is operatively coupled between a loud proximate the input ports and the first and second triaxial transmission line structures proximate the output port, thereby enabling unbalanced currents flowing between the first and second triaxial transmission line structures to flow to the load instead of the output port.

17. The power combiner of claim 16 wherein the length of semi-rigid coax cable forming part of the short-circuited stub is in the range of about one-quarter wavelength of a center frequency to about four-tenths wavelength at a highest frequency.

18. The power combiner of claim 16 wherein at least one of ferrite and dielectric materials are arranged along the semi-rigid coax cable forming part of short-circuted stub, so as to increase the impedance of the stub.

19. The system of claim 16 wherein each of the first and second triaxial transmission line structures includes a dielectric material between an outer conductor and a semi-rigid coax cable having its shield used as a center conductor of each of the first and second triaxial transmission line structures.

* * * * *